US007587826B1

(12) United States Patent
Stutz

(10) Patent No.: US 7,587,826 B1
(45) Date of Patent: Sep. 15, 2009

(54) HAND HELD VIBRATING KNIFE

(76) Inventor: John David Stutz, 6232 Oakglen Dr., Suffolk, VA (US) 23435

( * ) Notice: Subject to any disclaimer, the term of this patent is extended or adjusted under 35 U.S.C. 154(b) by 493 days.

(21) Appl. No.: 11/332,334

(22) Filed: Jan. 17, 2006

(51) Int. Cl.
*B26B 3/00* (2006.01)

(52) U.S. Cl. ..... 30/142; 30/165

(58) Field of Classification Search ..... 30/43.7–44, 30/208–210, 392–394, 142, 165; 606/169
See application file for complete search history.

(56) References Cited

U.S. PATENT DOCUMENTS 4,038,721 A * 8/1977 Kendzior ..... 30/394
4,255,858 A * 3/1981 Getts ..... 30/393
4,379,362 A * 4/1983 Getts ..... 30/393
4,432,117 A * 2/1984 Iskiw ..... 30/277.4
4,490,885 A * 1/1985 Iskiw ..... 30/277.4
4,821,357 A * 4/1989 Millette ..... 30/277.4
5,159,865 A * 11/1992 Hinckley ..... 30/140
5,261,922 A * 11/1993 Hood ..... 606/169
5,375,331 A * 12/1994 Meixner ..... 30/275.4
5,439,472 A * 8/1995 Evans et al. ..... 30/351
5,695,510 A * 12/1997 Hood ..... 606/169
5,702,360 A * 12/1997 Dieras et al. ..... 606/169
5,732,470 A * 3/1998 Labarbara ..... 30/44
5,935,142 A * 8/1999 Hood ..... 606/169
5,935,143 A * 8/1999 Hood ..... 606/169
5,964,039 A * 10/1999 Mizoguchi et al. ..... 30/392
6,357,117 B1 * 3/2002 Eichhorn et al. ..... 30/43.92
7,155,830 B2 * 1/2007 Sasaki et al. ..... 30/210
7,178,244 B2 * 2/2007 Fossella ..... 30/392

* cited by examiner

*Primary Examiner*—Jason Daniel Prone

(57) ABSTRACT

A hand-held electric knife is described that utilizes rotating elements to produce vibrations to assist in the cutting process. The elements may be arranged as to gyroscopically stabilize the tool while cutting.

5 Claims, 2 Drawing Sheets

HAND HELD VIBRATING KNIFE

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

It is known that the cutting process can be enhanced by the induction of vibrating motion parallel to the cutting edge. This enhancement can reduce the force required to drive the blade through an object and increase the cutting rate f the blade. Many cutting tools are available that utilize frequencies in the ultrasonic range greater than 30,000 cycles per second that produce very small vibrations. This invention utilizes frequencies within the sonic range and below to produce mush larger amplitude vibrations. The method of producing these vibrations is based upon rotation unbalanced elements instead of more expensive piezoelectric drive mechanisms.

BRIEF SUMMARY OF THE INVENTION

A rotating element or elements are mounted to a hand-held cutting tool such as a knife, cleaver, sword, or other hand held cutting tool and driven to rotate. At least one rotating element contains an imbalance that creates an oscillating force on the blade.

This method vibrates the entire blade and handle for hand held tools that require little complexity in the construction or operation of the tool. The hand or hands on the handle of the instrument will tend to partially dampen the amplitude of the resulting vibration. However, the amount of the imbalance and the rotational velocity of the imbalanced element(s) may be selected so that the dampened vibrations are still large enough to assist in the cutting process. Each rotating element produces a gyroscopic effect that may be used to stabilize the blade during the cutting process.

DETAILED DESCRIPTION OF THE INVENTION

The invention is a hand-held cutting tool in which at least one rotating element has an imbalance that creates oscillating forces on the cutting tool to enhance the cutting process.

Figure 1:
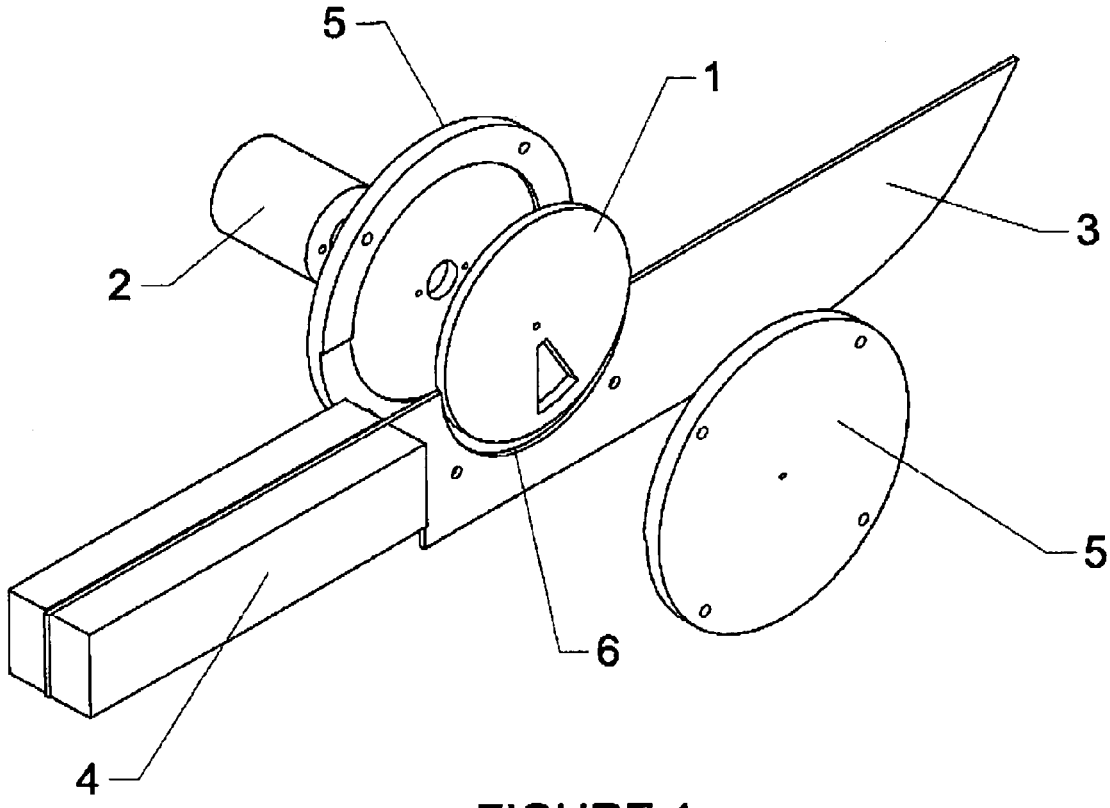
FIG. 1: An exploded view of a hand held knife with an unbalanced element driven by a motor. Electrical current source, wires, and fasteners not shown for clarification.

Referring to FIG. 1, the embodiment incorporates a blade 3 mounted to a handle 4. The blade 3 has a rear edge with a semi-circular cavity opposite a sharpened front edge interconnected by two sides. Connected to the two sides of the blade 3 are two cover plates 5. At least one of the cover plates has a cavity that is aligned with the cavity of the rear edge of the blade 3 when the blade 3 and cover plates 5 are connected. An element 1, which has an imbalance about an axis of rotation, is mounted and rotates within the aligned cavities. An electric motor 2 is connected to the element 1 so that a shaft of the motor will rotate the element 1 within the aligned cavities. The imbalance rotation of element 1 vibrates the cutting tool.

Figure 2:
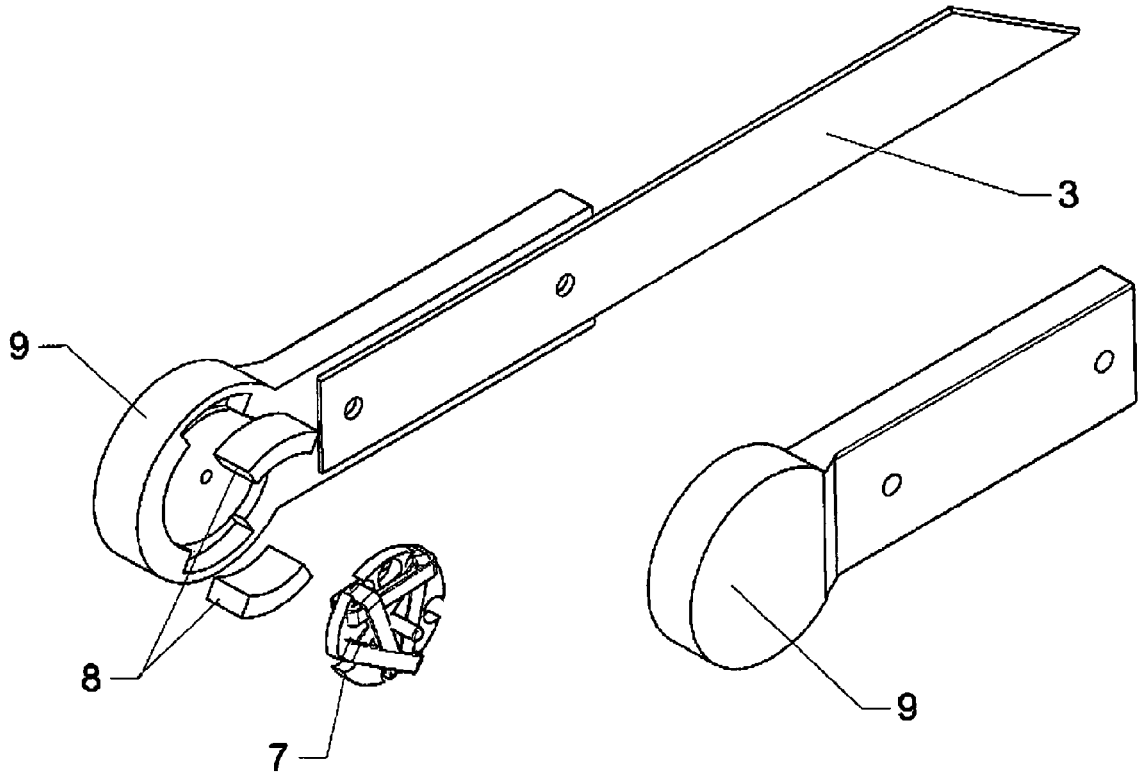
FIG. 2: An exploded view of an alternate configuration with a direct current electric motor embedded in the handle and the rotor of the motor having the desired imbalance. Electrical current source, wires, and fasteners not shown for clarification.

Referring to FIG. 2, an alternate configuration in which the rotating element is designed as the rotor of an electric motor to reduce size and weight. A blade 3 is mounted to a handle assembly 9 in which the rotor of an electric motor 7 is designed to have an imbalance. The magnets 8 and other motor components are mounted in the handle assembly 9.

Multiple rotating elements may be mounted to a single cutting tool. The rotating elements may be of any geometric shape or of any material.

The frequency of the rotation is controlled by controlling the motor to produce vibrations at varying frequencies for cutting different materials.

I claim:

1. A cutting tool comprising,

A handle;

a blade with a first edge, a sharpened second edge opposite the first edge, and two sides connecting the first and second edges; wherein the first edge has a first cavity;

a first cover plate with a second cavity and a second cover plate;

wherein the cover plates are attached to each other and to the sides of the blade so that the first and second cavities are in communication with each other;

and an imbalanced element mounted so as to rotate with an imbalance within the first and second cavities wherein the imbalance rotation vibrates the cutting tool.

2. The cutting tool of claim 1 further comprising an axis of rotation of the imbalanced element is orthogonal to a plane defined by the sharpened second edge.

3. The cutting tool of claim 1 further comprising the imbalanced element is rotated by a motor.

4. The cutting tool of claim 1 further comprising the cutting tool is a knife.

5. The cutting tool of claim 1 further comprising the cutting tool is a cleaver.

* * * * *